US009528521B2

(12) United States Patent
Pawellek

(10) Patent No.: US 9,528,521 B2
(45) Date of Patent: Dec. 27, 2016

(54) CONTROLLABLE COOLANT PUMP

(75) Inventor: Franz Pawellek, Lauteral (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 449 days.

(21) Appl. No.: 14/342,474

(22) PCT Filed: Aug. 17, 2012

(86) PCT No.: PCT/DE2012/000846

§ 371 (c)(1),
(2), (4) Date: Mar. 3, 2014

(87) PCT Pub. No.: WO2013/034126

PCT Pub. Date: Mar. 14, 2013

(65) Prior Publication Data

US 2014/0212267 A1 Jul. 31, 2014

(30) Foreign Application Priority Data

Sep. 9, 2011 (DE) ..... 10 2011 113 040

(51) Int. Cl.
*F04D 15/00* (2006.01)
*F04D 13/14* (2006.01)
(Continued)

(52) U.S. Cl.
CPC ..... *F04D 15/0022* (2013.01); *F01P 7/161* (2013.01); *F04D 13/14* (2013.01); *F04D 15/0038* (2013.01);
(Continued)

(58) Field of Classification Search
CPC ..... F04D 15/00; F04D 15/0005; F04D 15/0016–15/0022; F04D 15/0027; F04D 15/0033; F04D 15/0038; F04D 29/4293; F04D 29/466; F04D 29/5873
(Continued)

(56) References Cited

U.S. PATENT DOCUMENTS 4,094,613 A * 6/1978 Bracken ..... F04D 15/0038 251/282
5,169,286 A * 12/1992 Yamada ..... F04D 15/0038 277/558
(Continued)

FOREIGN PATENT DOCUMENTS

DE 44 07 984 A1 9/1995
DE 44 32 292 A1 3/1996
(Continued)

OTHER PUBLICATIONS

MTZ [Motortechnische Zeitschrift=Technical Motor/Engine Journal], Commercial Vehicle Powertrains Emission Versus Fuel Consumption, Jun. 2011, vol. 72, p. 466-474 (with English translation).
(Continued)

*Primary Examiner* — Alexander Comley
(74) *Attorney, Agent, or Firm* — Collard & Roe, P.C.

(57) ABSTRACT

A controllable coolant pump driven by a belt pulley for internal combustion engines is equipped with a valve slide. A seal is disposed on the outer edge of the wall plate between the plate and the outer cylinder of the valve slide. At least one additional flow outlet opening is disposed on the pump housing, the outlet volume stream of which openings can be additionally controlled, aside from the controllable volume stream that exits from the flow exit opening. The flow outlet opening from which the controllable outlet volume stream exits is connected with an outflow opening disposed near the rear wall of the valve slide, in the pump chamber rear wall, via an outflow channel. The outflow opening is enclosed by a ring seal disposed in the pump chamber rear wall, which enters into operative engagement with the valve slide in its rear end position.

5 Claims, 3 Drawing Sheets

Figure 1:
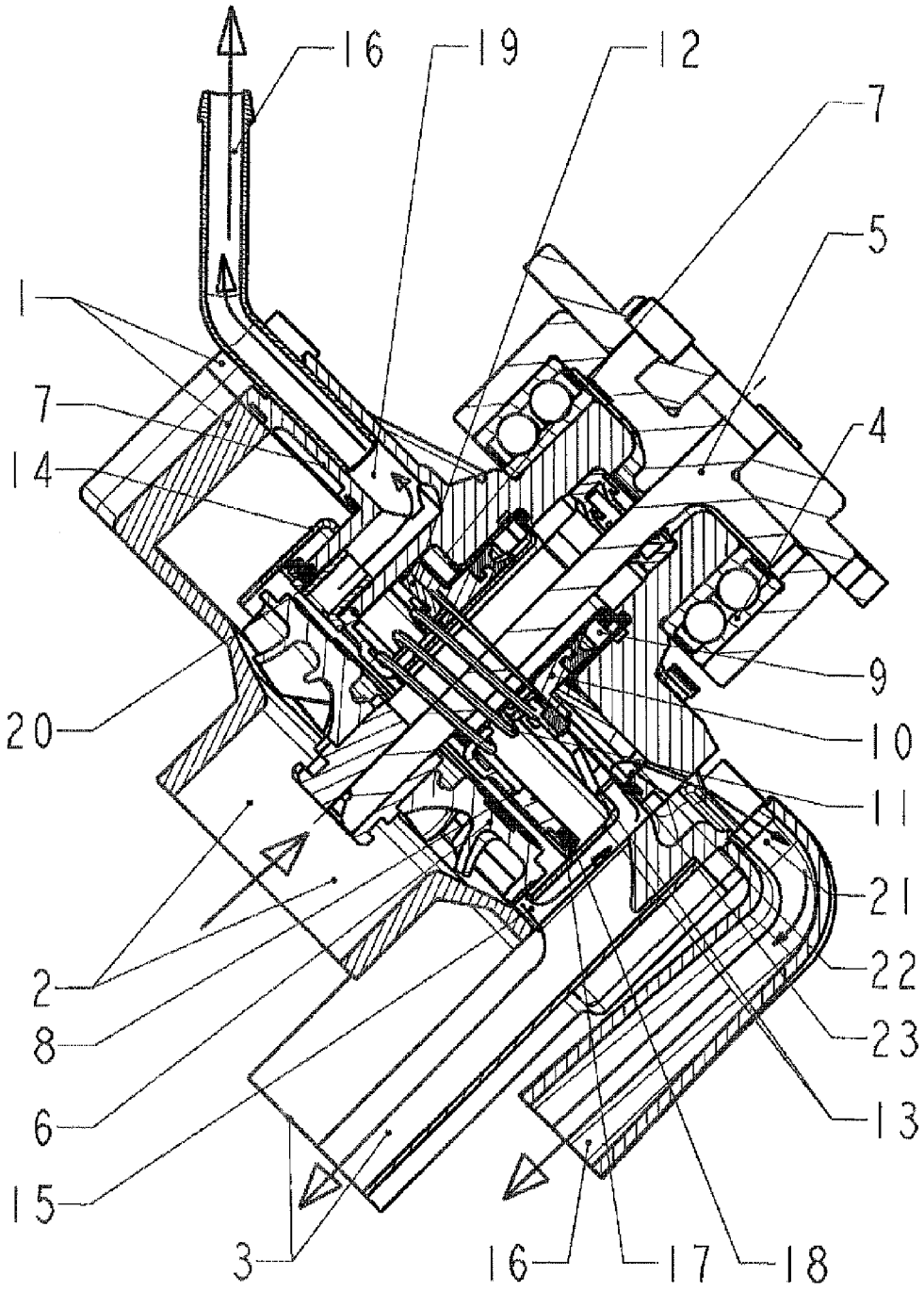

(51) Int. Cl.
*F01P 7/16* (2006.01)
*F01P 7/14* (2006.01)

(52) U.S. Cl.
CPC ..... *F01P 2007/146* (2013.01); *F05D 2270/64* (2013.01)

(58) Field of Classification Search
USPC .... 415/26, 158; 417/26, 27, 307; 123/41.44, 123/41.47
See application file for complete search history.

(56) References Cited

U.S. PATENT DOCUMENTS 8,297,942 B2 * 10/2012 Schmidt ..... F04B 23/106 415/158
8,628,295 B2 1/2014 Schmidt et al.
9,273,674 B2 * 3/2016 Schmidt ..... F04D 15/0038
2002/0012583 A1 * 1/2002 Hesse ..... F04D 15/0038 415/47
2008/0283101 A1 * 11/2008 Pardini ..... A47L 15/4225 134/174
2008/0317609 A1 * 12/2008 Schmidt ..... F04D 15/0038 417/307
2011/0088638 A1 * 4/2011 Yamagata ..... F01P 5/10 123/41.44
2011/0162597 A1 * 7/2011 Draheim ..... F04D 15/0038 123/41.44
2012/0111291 A1 * 5/2012 Popp ..... F01P 7/162 123/41.09
2014/0050562 A1 * 2/2014 Welte ..... F04D 5/002 415/55.1

FOREIGN PATENT DOCUMENTS

DE 10 2004 054 637 B4 5/2006
DE 10 2007 022 189 A1 11/2008
DE 10 2008 022 354 A1 11/2009
DE 10 2008 026 218 A1 12/2009
DE 10 2009 036 602 A1 2/2011
DE 102009036602 A1 * 2/2011 ..... F04D 15/0038
EP 2 169 233 A2 3/2010
EP 2169233 A2 * 3/2010 ..... F01P 7/161
WO 2009/143832 A2 12/2009

OTHER PUBLICATIONS

International Search Report of PCT/DE2012/000846, mailed Nov. 21, 2012.

* cited by examiner

CONTROLLABLE COOLANT PUMP

CROSS REFERENCE TO RELATED APPLICATIONS

This application is the National Stage of PCT/DE2012/000846 filed on Aug. 17, 2012, which claims priority under 35 U.S.C. §119 of German Application No. 10 2011 113 040.7 filed on Sep. 9, 2011, the disclosure of which is incorporated by reference. The international application under PCT article 21(2) was not published in English.

The invention relates to a controllable coolant pump driven by way of a belt pulley, for internal combustion engines.

In the course of constant optimization of internal combustion engines with regard to the lowest emissions and low fuel consumption, warming up of the engine after a cold start, as quickly as possible, has great importance. The following interrelationships come to bear in this.

The viscosity of the oil decreases with an increasing oil temperature, and, at the same time, the friction at all oil-lubricated moving components also decreases.

At the same time, after what is called the "start-up temperature," the catalysts also become active, so that it is aimed at to further shorten this time window, in order to thereby guarantee that the catalysts become effective quickly.

Experiments within the scope of engine development have shown that a very effective measure for faster engine warm-up is the "standing water" during the cold-start phase. For this reason, the coolant volume situated in the water jacket of the cylinder block should not be exchanged during the cold-start phase, in order to prevent any unnecessary heat transport.

Likewise, the cylinder head should also not have coolant flowing through it during the cold-start phase, in order to bring the exhaust gas temperature to the desired level as quickly as possible.

In order to bring about this fastest possible engine warm-up, switchable coolant pumps were introduced in past years, with great success, which make it possible to reduce the coolant volume stream that exits from the pump to "zero" during the cold-start phase. A design of this switchable pump that has proven itself in practice was also disclosed by the applicant in WO 2009/143832 A2.

During the further course of engine development, with the target direction of further lowering of fuel consumption, what are called split-cooling systems are increasingly being used at this time.

In these new systems, the cylinder head and the cylinder block are supplied with an individually controlled coolant stream, by way of separate connectors.

The background of these systems is the fact that the cylinder block should preferably experience higher coolant temperatures than the cylinder head. The oil-lubrication friction locations in the cylinder block (i.e. the piston module and the crankshaft bearings) cause greater friction losses, because of the reduced oil viscosity at higher working temperatures.

For the cylinder head, in contrast, the requirement exists, after the engine has warmed up (i.e. after the cold-start phase), to reliably protect the valve crosspieces, which are subject to thermal stress, by means of good cooling, and furthermore to bring about good filling of the combustion chamber.

In the state of the art, cooling systems or distributor devices for the cooling system of internal combustion engines, having split-cooling concepts, were already described in DE 44 07 984 A1 and in DE 44 32 292 A1, which allow individual flow through the cylinder head and the cylinder block.

The significant disadvantage of these systems described in DE 44 07 984 A1 and also in DE 44 32 292 A1 is not only the great equipment technology effort, which necessarily requires not only the coolant pump but also separate lines and valves in the cooling circuit, which can then be opened or closed as needed, but also the great construction volume connected with these systems.

A more recent solution of the split-cooling systems was described in MTZ [Motortechnische Zeitschrift=Technical Motor/Engine Journal] June 2011 on page 473. Here, the valves required to control the volume streams are brought together in the pump housing; two electrically driven rotary slide valves are required for this purpose.

In this solution, too, the equipment technology effort and the construction volume are enormous. This solution is also eliminated for many engine applications, if only due to the great required construction volume.

Further controllable pumps are known from DE 10 2008 026 218 A1 and DE 10 2004 034 637 B4.

Furthermore, a cooling system for liquid-cooled internal combustion engines is known from EP 2 169 233 A2, having a multi-flow coolant pump, the pump flows of which are assigned to separate coolant circuits, in each instance, and in which at least one of the pump flows can be changed, with regard to the conveying output, by means of a valve slide.

Furthermore, a controllable coolant pump is known from DE 10 2009 036 602 A1, having an inlet channel, a pump wheel, and a displaceable valve slide disposed on the outer circumference of the pump wheel, which pump is characterized in that at least three outlet channels that proceed in spiral shape from the pump wheel are disposed in the pump housing, whereby the valve slide always controls, i.e. opens or closes all three outlet channels at the same time.

The invention is therefore based on the task of developing a controllable coolant pump that can be driven by way of a belt pulley, which eliminates the aforementioned disadvantages of the state of the art, and, in this connection, on the one hand guarantees optimal warm-up of the engine during the cold-start phase, by means of complete "zero leakage," and, at the same time, on the other hand allows individually controllable flow of coolant through cylinder head and cylinder block, at a low drive power, with minimal equipment technology effort and the smallest possible construction space requirement, i.e. even with a very limited installation space for the coolant pump in the engine space, in order to guarantee optimal, demand-appropriate, individual cooling of cylinder block and cylinder head both during the cold-start phase and in ongoing operation, so that not only the cylinder block but also the cylinder head can be run at optimal working temperatures, in individually controllable manner, so that the friction losses, the fuel consumption and also the emission of pollutants are clearly reduced over the entire working range of the engine, whereby the solution to be developed, in special designs, is supposed to guarantee not only separate, individually controlled coolant supply to cylinder head and cylinder block, but also, at the same time, without great additional effort and construction space, continuous cooling of the exhaust gas recirculation.

According to the invention, this task is accomplished by means of a controllable coolant pump for internal combustion engines, driven by way of a belt pulley, in accordance with the characteristics of the independent claim of the invention.

Advantageous embodiments, details, and characteristics of the invention are evident from the dependent claims and from the following description of the solution according to the invention, in connection with the three representations of two different designs of the solution according to the invention.

Figure 2:
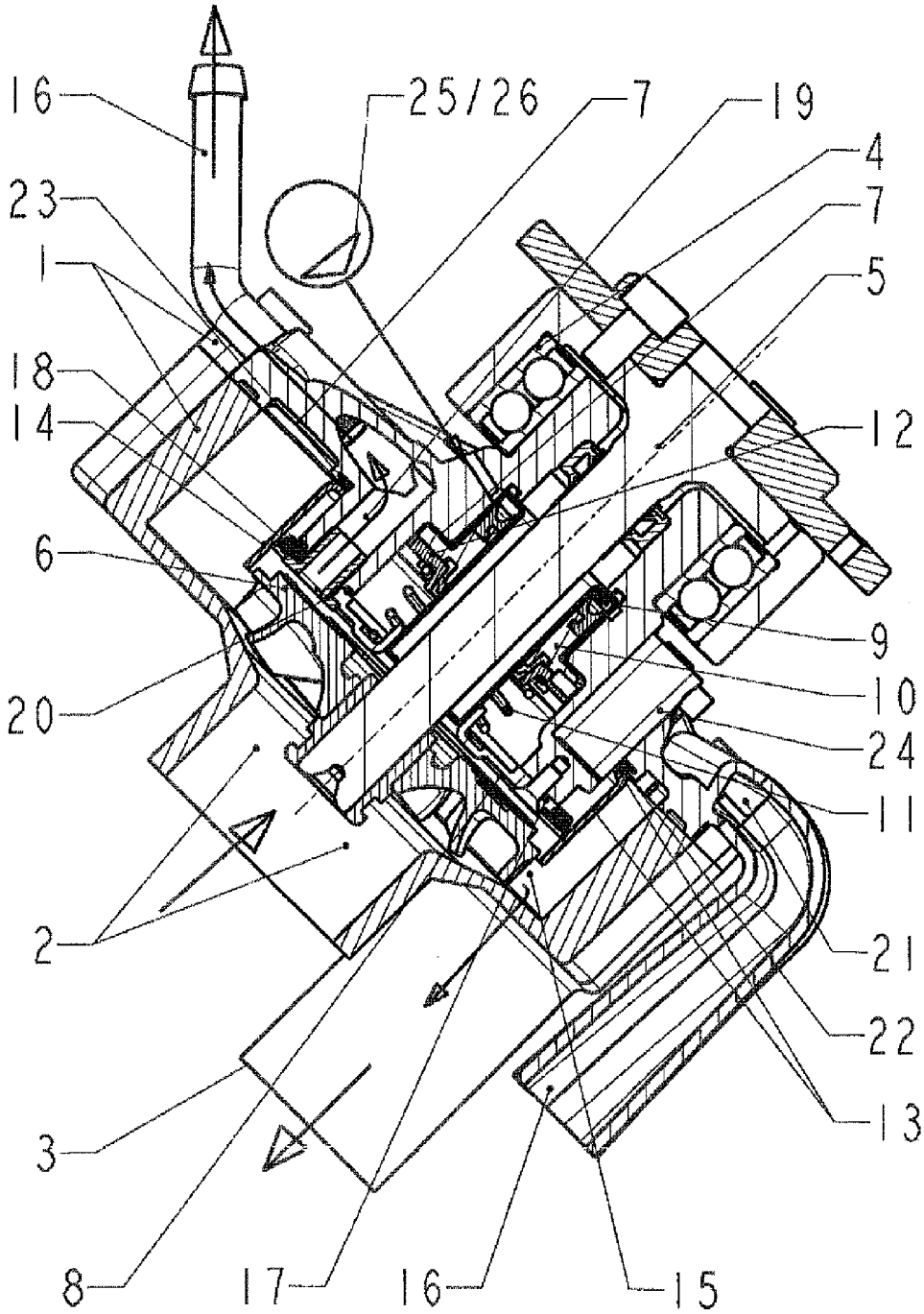
Figure 3:
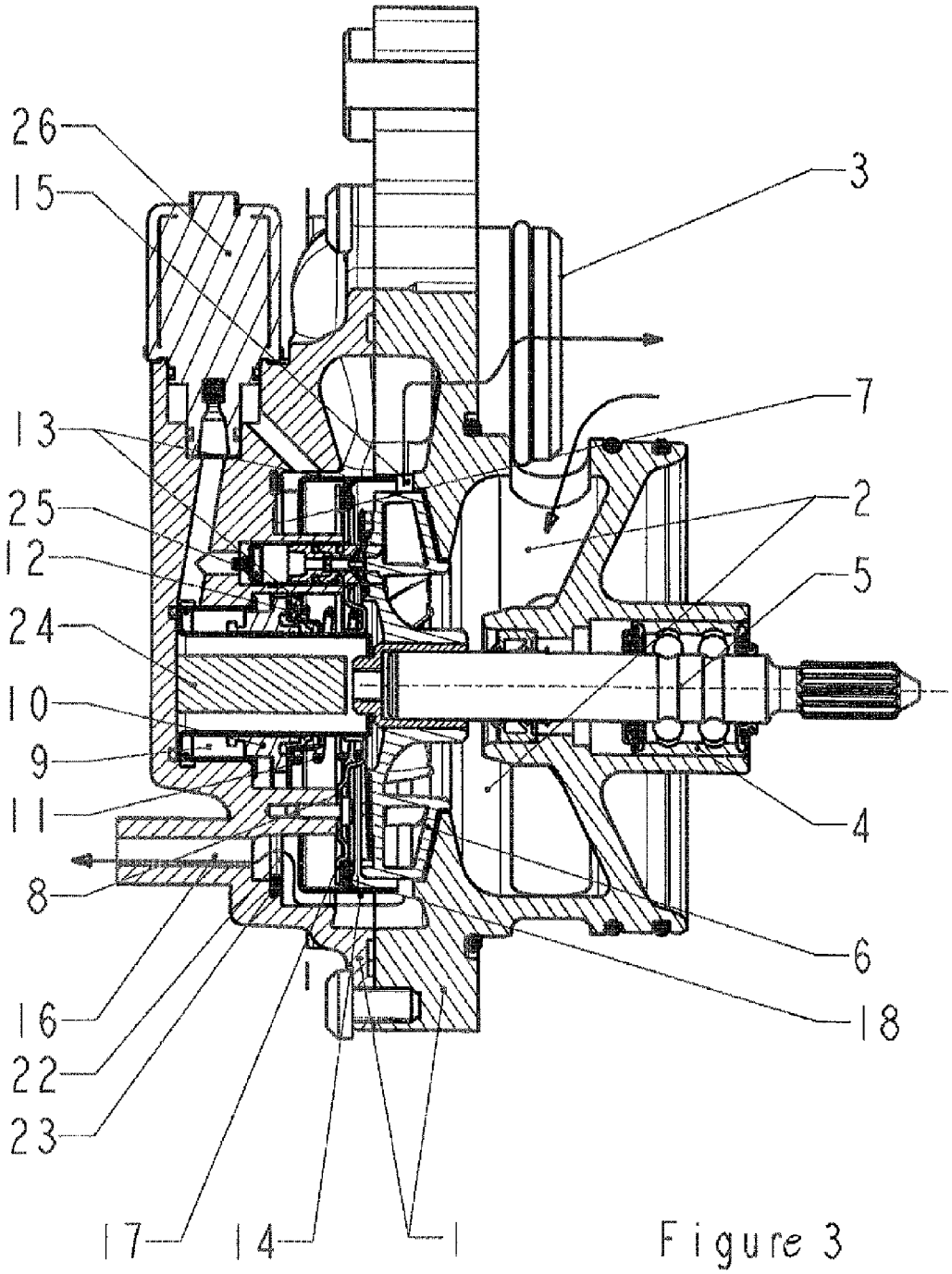

In this connection, the drawings show, in:

FIG. 1: the controllable coolant pump according to the invention, in a design for individually controlled coolant supply to cylinder head and cylinder block, and simultaneous continuous coolant supply to the exhaust gas recirculation, in section, in a side view, with the valve slide used in the solution in a center position;

FIG. 2: the controllable coolant pump according to the invention, according to FIG. 1, for individually controlled coolant supply to cylinder head and cylinder block, and simultaneous continuous coolant supply to the exhaust gas recirculation, in a further section, again in a side view and with the valve slide used in the solution now in the rear end position;

FIG. 3: the controllable coolant pump according to the invention, in a further design for individually controlled coolant supply to cylinder head and cylinder block, in section, in a side view, with the valve slide also used in the solution in a center position.

FIG. 1 shows the controllable coolant pump according to the invention, in a design for individually controlled coolant supply to cylinder head and cylinder block and simultaneous continuous coolant supply to the exhaust gas recirculation, for example, in a side view, in section, with the position of the valve slide in a center position.

A pump shaft 5, driven by a belt pulley, for example, is disposed in a pump housing 1 having a flow entry region 2 and a flow exit opening 3 for exit of a controllable conveyed volume stream, in a pump bearing 4.

An impeller wheel 6 is disposed at the free, flow-side end of this pump shaft 5, so as to rotate with it. The pump chamber rear wall 7 is situated between the impeller wheel 6 and the pump bearing 4.

A wall plate 8 is disposed between the impeller wheel 6 and the pump chamber rear wall 7, fixed in place on the housing. A working cylinder 9 is disposed on the circumference of the pump shaft 5, fixed in place on the housing, in the pump housing 1, in which cylinder a working piston 10 is movably disposed, activated by control pressure.

The rear wall 12 of a valve slide 13 having an outer cylinder 14 is disposed on the working piston 10. This outer cylinder 14, which is variably movable using the working piston 10, now covers the outflow region 15 of the impeller wheel 6, as a function of the control pressure.

A reset spring 11 is disposed between the wall plate 8 fixed on the housing and the working piston(s) 10 that can be moved in the longitudinal pump shaft direction or the valve slide 13 that is connected with the working piston 10, which spring guarantees precise, reproducible positioning of the outer cylinder 14 at the outflow region 15 of the impeller wheel 6, as a function of the control pressure.

It is essential to the invention that a seal 18 is disposed on the outer edge 17 of the wall plate 8, between the edge and the outer cylinder 14 of the valve slide 13.

This seal 18 prevents flow around the valve slide 13 in the region of the outer edge 17 of the wall plate 8 and thereby allows separate pressure buildup in front of and behind the wall plate 8.

According to the invention, two further flow outlet openings 16 are disposed on the pump housing 1, whereby the outlet volume stream that exits from one of the flow outlet openings 16 cannot be controlled, and here serves for continuous coolant supply to the exhaust gas recirculation.

The outlet volume stream that exits from the other flow outlet opening 16 can be controlled, along with the controllable volume stream that exits from the flow exit opening 3.

It is characteristic that the flow outlet opening 16 from which the non-controllable outlet volume stream exits is directly connected with an outlet connector 20 disposed in the wall plate 8, by means of an outlet channel 19, in the pump housing 1.

It is also essential to the invention that the other flow outlet opening 16, from which not only the controllable volume stream that exits from the flow exit opening 3 but also a controllable outlet volume stream exit, is connected with an outflow opening 22 disposed in the region of the rear wall 12 of the valve slide 13, in the pump chamber rear wall 7, by way of an outflow channel 21, whereby this outflow opening 22 is enclosed by a ring seal 23 disposed in the pump chamber rear wall 7, which enters into operative engagement with the valve slide 13 in the rear end position of the latter.

The solution according to the invention makes it possible that even when the outer cylinder 14 of the valve slide 13 lies against the housing in the front end position, i.e. when the outer cylinder 14 of the valve slide 13 covers the outflow region of the impeller wheel, an uncontrolled coolant volume stream along the inner wall of the outer cylinder 14, by way of the outlet connector 20, into the outlet channel 19, for cooling of the exhaust gas recirculation, is guaranteed, as it is, of course, in every other position of the valve slide, as well.

The two aforementioned controllable volume streams of the coolant pump according to the invention are integrated, according to the invention, into an individual through-flow of cylinder head and cylinder block of an internal combustion engine, as follows.

The controllable volume stream that exits from the flow exit opening 3 serves for separate, controlled coolant supply to the cylinder head, and the controllable outlet volume stream that furthermore exits from the controllable coolant pump according to the invention by way of the outflow opening 22 and the outflow channel 21 disposed in the pump chamber rear wall 7 serve for separate, controlled coolant supply to the cylinder block.

In the design shown in FIGS. 1 and 2, the control pressure in the working cylinder(s) 9 is generated for defined displacement of the valve slide 13 by a working pump 25 disposed outside of the pump housing 1, and controlled by way of a working valve 26 disposed outside of the pump housing 1.

In the cold-start phase, the valve slide 13 is first moved into the front end position, so that the outer cylinder 14 of the valve slide 13 lies against the housing.

This position of the valve slide is not shown in any of the two FIGS. 1 and 2.

In this front end position, the valve slide brings about the result that both of the controllable volume streams that exit from the coolant pump according to the invention,

- i.e. the controllable volume stream that exits from the flow exit opening 3,
- and the controllable outlet volume stream that exits by way of the outflow opening 22 disposed in the pump chamber rear wall 7 and the outflow channel 21 are completely regulated.

This front end position of the valve slide guarantees fast engine warm-up during the cold-start phase by means of the "standing water," thereby avoiding any unnecessary heat transport, so that rapid warm-up of all modules of the engine is guaranteed during the cold-start phase.

After the operating temperature of the cylinder head has been reached in the cold-start phase, the valve slide moves into the rear end position under a partial load, by means of spring reset. Through-flow and cooling of the cylinder head are now released, while through-flow of the cylinder block continues to be prevented. In this manner, the oil temperature can be further increased at the relevant friction locations such as the piston module and crankshaft bearing, despite active cylinder head cooling, and thus the viscous oil friction can be further reduced. Only once the oil temperature reaches the predetermined limit value is the valve slide moved into a defined intermediate position, and thereby demand-appropriate cooling of the cylinder block and of the cylinder head is released.

As a result of the spring reset of the valve slide, through-flow of the cylinder block is prevented when the internal combustion engine is shut off, and as a result, the stored heat energy can be stored longer and is available again when the engine is started again.

This positive effect is particularly active if what is called an electrical over-run pump is used, which serves for cooling components subject to great thermal stress, such as the turbocharger. Even in the case of active over-run cooling, the stored heat of the engine block is maintained and contributes to a reduction in fuel consumption when the engine is started again.

One of these possible defined intermediate positions of the valve slide, which are moved to within the scope of demand-appropriate cooling of the cylinder block and of the cylinder head, is the center position shown in FIG. 1, for example, whereby the demand appropriate through-flow of cylinder head and cylinder block, as explained, is guaranteed as a function of the position of the valve slide, in each instance.

FIG. 2 now shows the controllable coolant pump according to the invention from FIG. 1, with continuous coolant supply to the exhaust gas recirculation by way of the outlet channel 19, with a section that lies somewhat differently, in a side view.

The section line is selected, in this FIG. 2, in such a manner that now a path measurement sensor 24 disposed in the pump housing becomes visible, which serves to precisely detect the position of the valve slide, in each instance, in order to control the valve slide by way of regulating the control pressure of the working pump 25, in such a manner that demand-appropriate individual coolant supply to cylinder head and cylinder block is guaranteed.

In FIG. 2, the valve slide is now situated in its rear end position and lies against the ring seal 23 disposed in the pump chamber rear wall 7 there, in its transition region from the outer cylinder 14 into the rear wall 12, from the press-down pressure of the reset spring 11, and thereby closes the outflow opening 22 disposed in the pump chamber rear wall 7, forming a seal.

This position of the valve slide, shown in FIG. 2, in its rear end position, brings about very good cooling of the cylinder head in accordance with the required current coolant demand, in each instance, in the case of a non-cooled cylinder block (cool head and warm feet).

In FIG. 3, another design of the controllable coolant pump according to the invention, for individually controlled coolant supply to cylinder head and cylinder block is now shown in section, in a side view. This solution shown in FIG. 3 represents a further development of the design of a controllable coolant pump already disclosed by the applicant in WO 2009/143832 A2, which has proven itself in practice for many years, in which the control pressure in the working cylinder 9 is generated for defined displacement of the valve slide 13, by a working pump 25 disposed in the pump housing 1, and is controlled by way of a working valve 26 disposed in the pump housing 1.

The solution shown in FIG. 3 now allows, as was already explained in connection with FIGS. 1 and 2, demand-dependent individually controlled separate coolant supply to cylinder head and cylinder block.

In this representation, the valve slide 13 is again in a center position, analogous to FIG. 1.

The path measurement sensor 24 also shown in FIG. 3, in operative engagement with the working pump 25 disposed in the pump housing 1 and the working valve 26 also disposed in the pump housing 1, guarantees, by means of precise detection of the working position of the valve slide 13, in each instance, in connection with precise regulation of the control pressure of the working pump 25, that the coolant supply to cylinder head and cylinder block can be individually controlled as a function of demand.

In the case of the design shown in FIG. 3, as well, the controllable volume stream that exits from the flow exit opening 3 serves for separate controlled coolant supply to the cylinder head, and the additional controllable outlet volume stream that also exits from the controllable coolant pump according to the invention, by way of the outflow opening 22 disposed in the pump chamber rear wall 7 and the outflow channel 21, serves for separate controlled coolant supply to the cylinder block.

The explanations concerning the method of effect and the function of the controllable coolant pump according to the invention, in connection with FIGS. 1 and 2, apply in the figurative sense also for the design shown in FIG. 3.

It is possible that the cylinder block can be operated at a higher coolant temperature, as compared with the cylinder head, during ongoing operation, by means of the solution according to the invention, thereby clearly reducing not only the pollutant emissions but also the friction losses and the fuel consumption over the entire working range of the engine. By means of the solution presented here, separate coolant supply to cylinder head and cylinder block can be guaranteed with the least construction space requirement, i.e. even in the case of very greatly limited installation space for the coolant pump in the engine space.

At the same time, reliable activation of the valve slide is always guaranteed, at very low drive power.

In the case of the design shown in FIG. 3, as well, not only can separate, individually controlled coolant supply to cylinder head and cylinder block be guaranteed, by means of placing an outlet connector 20 in the wall plate 8 and connecting this outlet connector 20 with a flow outlet opening 16, by way of an outlet channel 19 (analogous to the representations in FIGS. 1 and 2), but so can continuous cooling of the exhaust gas recirculation (as was already explained in connection with FIGS. 1 and 2).

REFERENCE SYMBOL LIST

1 pump housing
2 flow entry region
3 flow exit opening
4 pump bearing
5 pump shaft
6 impeller wheel
7 pump chamber rear wall
8 wall plate

9 working cylinder
10 working piston
11 reset spring
12 rear wall
13 valve slide
14 outer cylinder
15 outflow region
16 flow outlet opening
17 outer edge
18 seal
19 outlet channel
20 outlet connector
21 outflow channel
22 outflow opening
23 ring seal
24 path measurement sensor
25 working pump
26 working valve

The invention claimed is:

1. A controllable coolant pump comprising:

a one-part or multi-part pump housing, a flow entry region, a flow exit opening for discharge of a controllable conveyed volume stream, a pump bearing connected to the pump housing, a pump shaft in the pump bearing having a free, flow-side end, and extending in a longitudinal pump shaft direction, an impeller wheel disposed at the free, flow-side end of the pump shaft so as to rotate with the pump shaft, the impeller wheel having an outflow region, a pump chamber rear wall disposed in the pump housing between the impeller wheel and the pump bearing, a wall plate fixed in place on the pump housing between the impeller wheel and the pump chamber rear wall and having an outer edge, one or more working cylinder(s) disposed in the pump housing, one or more working piston(s) disposed in the one or more working cylinder(s) to be activated by control pressure to move in the longitudinal pump shaft direction, a valve slide having a valve slide rear wall and an outer cylinder, the valve side being connected to the one or more working piston(s) and having a rear end position, the outer cylinder variably covering the outflow region of the impeller wheel as a function of the control pressure, a reset spring disposed between the wall plate and the one or more working piston(s) or between the wall plate and the valve slide, a seal disposed on the outer edge of the wall plate between the outer edge and the outer cylinder of the valve slide, one or more additional flow outlet openings disposed on the pump housing and having an outlet volume able to be controlled, an outflow opening in the pump chamber rear wall and in a region of the valve slide rear wall, an outflow channel connecting the outflow opening with the one or more additional flow outlet opening(s), and a ring seal enclosing wherein the outflow opening, the ring seal being disposed in the pump chamber rear wall and entering into operative engagement with the valve slide in the rear end position of the valve slide.

2. The controllable coolant pump according to claim 1, further comprising:

one or more non-controllable flow outlet opening(s) connected to the pump housing and having an outlet volume stream not able to be controlled, an outlet channel in the pump housing, and an outlet connector disposed in the wall plate and directly connecting the one or more non-controllable flow outlet opening(s) with the outlet connector.

3. Controllable coolant pump according to claim 1, wherein a path measurement sensor is disposed in the pump housing the path measurement sensor being configured to detect a position of the valve slide.

4. The controllable coolant pump according to claim 1, further comprising:

a working pump in the pump housing and generating the control pressure in the one or more working cylinder(s) for defined displacement of the valve slide, and a working valve in the pump housing and controlling the control pressure.

5. The controllable coolant pump according to claim 1, further comprising:

a working pump disposed outside of the pump housing and generating the control pressure in the one or more working cylinder(s) for defined displacement of the valve slide, and a working valve disposed in or outside of the pump housing and controlling the control pressure.

* * * * *